US006220877B1

(12) United States Patent
Alexander et al.

(10) Patent No.: US 6,220,877 B1
(45) Date of Patent: Apr. 24, 2001

(54) MONOLITHIC TERMINAL INTERFACE

(75) Inventors: Thomas Alexander, Trenton; Stefano Spadoni, Dearborn, both of MI (US)

(73) Assignee: Alcoa Fujikura Limited, Brentwood, TN (US)

( * ) Notice: Subject to any disclaimer, the term of this patent is extended or adjusted under 35 U.S.C. 154(b) by 0 days.

(21) Appl. No.: 09/565,089

(22) Filed: May 5, 2000

(51) Int. Cl.[7] ..... H01R 12/00
(52) U.S. Cl. ..... 439/82
(58) Field of Search ..... 439/55, 82, 81, 439/931, 45

(56) References Cited

U.S. PATENT DOCUMENTS

| | | | | |
|---|---|---|---|---|
| 3,218,606 | * | 11/1965 | Schultz | 439/82 |
| 4,076,355 | * | 2/1978 | Olsson et al. | 439/82 |
| 4,950,173 | * | 8/1990 | Minemura et al. | 439/82 |
| 5,127,838 | | 7/1992 | Zaderej et al. | 439/74 |
| 5,199,879 | * | 4/1993 | Kohn et al. | 439/82 |
| 5,427,532 | | 6/1995 | Owen et al. | 439/57 |
| 5,626,483 | | 5/1997 | Naitoh | 439/74 |
| 5,647,768 | | 7/1997 | Messuri et al. | 439/620 |
| 5,653,601 | * | 8/1997 | Martucci et al. | 439/82 |
| 5,743,764 | | 4/1998 | Czeschka et al. | 439/607 |
| 5,795,171 | | 8/1998 | Bernardini | 439/260 |
| 6,077,094 | * | 6/2000 | Bock et al. | 439/82 |

* cited by examiner

*Primary Examiner*—Paula Bradley
*Assistant Examiner*—Tho D. Ta
(74) *Attorney, Agent, or Firm*—Tracey D. Beiriger

(57) ABSTRACT

A monolithic terminal interface for supporting, and establishing electrical contact to, components such as relays and fuses includes a terminal board fabricated from a self-supporting sheet of resilient, electrically insulating material. The terminal board includes one or more terminal sockets, each being defined by a terminal slot formed through the board. The terminal slot creates opposed contact beams which include contact portions spaced by a distance less than the thickness of a terminal. The contact portions of the contact beams engage a terminal inserted therebetween, and because of the resilient nature of the material of the board, maintain contact pressure with the terminal. A pattern of metalization extends across at least one face of the board and into the terminal slot so as to cover the contact regions in this manner, electrical contact can be established through the conductive metal pattern to a terminal inserted in the slot. The monolithic terminal interface can be used to fabricate a power distribution box for a motor vehicle.

16 Claims, 3 Drawing Sheets

MONOLITHIC TERMINAL INTERFACE

FIELD OF THE INVENTION

This invention relates generally to electrical terminals. More specifically, the invention relates to a monolithic terminal array for establishing electrical communication with one or more electrical devices. Most specifically, the invention relates to an improved terminal interface for use in an electrical distribution box.

BACKGROUND OF THE INVENTION

The control and operational systems of a wide variety of apparatus such as motor vehicles, appliances, industrial equipment and the like, include a large number of electrical devices such as relays, fuses, and switches. In most instances, these electrical devices must be capable of being removed and replaced from the associated equipment to allow for assembly, maintenance and repair; therefore, such devices typically include plug-in terminals which engage corresponding connector terminals in the power distribution system of the associated equipment. Therefore, motor vehicles and other equipment typically include a terminal assembly, often disposed within an electrical power distribution box.

Many of the electrical devices carry relatively large electrical currents. In addition, motor vehicles and industrial equipment typically encounter mechanical shocks, large temperature cycles, and adverse environmental conditions in the course of their use. Therefore, the terminal assemblies employed in such systems need to be rugged, stable, and capable of carrying relatively large amounts of electrical power. In addition, it is generally desirable that the terminal assemblies themselves do not introduce unwanted resistance into the electrical circuit. Because of the foregoing considerations, terminal assemblies heretofore employed in motor vehicles and industrial equipment typically included terminal interfaces fabricated from a number of discrete mechanical components such as spring contacts, electrically conductive metal frets, prong assemblies and molded socket members, all of relatively complex design. Such assemblies are large in size, expensive and heavy. In addition, the presence of a number of discrete components can give rise to failures, particularly when the assemblies are subject to mechanical vibration or thermal stress.

Clearly, motor vehicles and other systems would benefit from the use of a terminal assembly which is lightweight, reliable, small in size, and easy to fabricate. As will be explained in further detail hereinbelow, the present invention provides a terminal assembly which is monolithic, and as used herein, the term shall refer to a terminal assembly which is formed from a unitary body of material and which provides reliable and secure contact to the terminal without the need to employ any separate components such as springs, inserts, retainers, or connectors. It is to be understood that the terminal interface of the present invention may, in some instances, include one or more separate components, such as auxiliary connector terminals, cable connectors and the like affixed thereto; however, such auxiliary components do not function to retain the terminals of the electronic devices; therefore, terminal interfaces including such auxiliary hardware are still considered monolithic within the context of this disclosure.

As will be explained in detail, the terminal interface of the present invention is fabricated from a particularly configured body of electrically insulating material having an electrically conductive pattern disposed thereupon. While the prior art has recognized that metalized polymeric components can be utilized to establish electrical contact to various devices and systems, the prior art has not ever utilized metalized polymers to make a monolithic terminal assembly capable of both powering and supporting relatively large, multi-terminal electrical devices such as fuses, relays and the like. Metalized polymeric connectors are shown, for example, in U.S. Pat. Nos. 5,795,171; 5,427,532; 5,127,838; 5,647,768; 5,626,483 and 5,743,764. However, none of the foregoing patents disclose the terminal assembly of the present invention.

BRIEF DESCRIPTION OF THE INVENTION

There is disclosed herein a monolithic terminal interface for receiving and retaining a terminal of an electrical device. The interface includes a terminal board which is comprised of a self-supporting sheet of resilient, electrically insulating material having opposed first and second faces. The terminal board has at least one terminal slot defined therethrough. The slot has a length dimension L, a first width dimension $W_1$ and a second width dimension $W_2$ which is less than $W_1$. The width dimensions are measured transverse to the length dimension. The terminal slot defines a first and a second contact beam in said terminal board. Each contact beam has a length dimension equal to $L_1$ and each includes a contact region defined thereupon. The contact beams are in an opposed relationship so that the contact region of the first beam is spaced from the second beam. The terminal slot and contact beams define a terminal socket in the board which is configured to receive and retain an electrical terminal member which has a thickness less than $W_1$ but greater than $W_2$. A pattern of an electrically conductive material is disposed on the terminal board so as to extend into the terminal slot and cover at least a portion of the contact region of at least one of the contact beams.

In specific embodiments, the terminal board includes a number of terminal slots formed therein so as to define a number of terminal sockets. In such embodiments, the pattern of electrically conductive material comprises a number of electrically isolated, conductive bodies which are disposed in communication with various of the terminal sockets. The conductive material may further be configured to provide one or more contact regions for establishing electrical communication between an external source of power and selected ones of the terminal sockets.

Also disclosed herein is an electrical power distribution box for a motor vehicle or the like which includes the monolithic terminal interface.

DETAILED DESCRIPTION OF THE INVENTION

The present invention is directed to a monolithic terminal interface. As described above, the terminal interface is configured to support, retain, and establish electrical communication to an electrical device such as a relay, fuse or the like. Being monolithic, the interface does not require any separate parts, and is therefore rugged, reliable and simple to fabricate.

Figure 1:
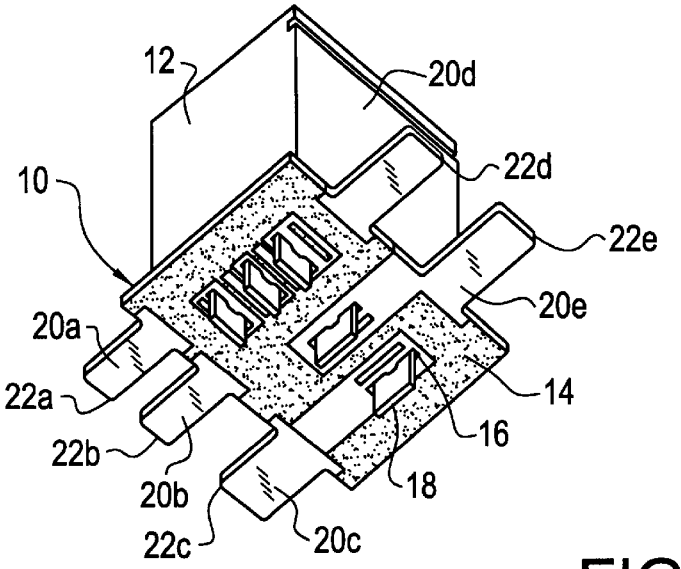
FIG. 1 is a bottom, perspective view of a terminal interface of the present invention having an electrical device retained thereupon.

Referring now to FIG. 1, there is shown one embodiment of the present invention wherein a terminal interface 10 structured in accord with the principles of the present invention has an electrical relay 12 retained thereupon. The interface comprises a terminal board 14 which will be described in greater detail hereinbelow. The board 14 includes a number of terminal sockets, for example socket 16, which are configured to receive and retain a terminal, for example terminal 18, of the relay 12. The terminal board includes a pattern of electrically conductive material disposed thereupon for establishing electrical communication with the sockets, and as illustrated in FIG. 1, the pattern of electrically conductive material comprises a number of separate bodies 20*a*–20*e*. The conductive bodies 20 establish electrical communication with various of the sockets, and also extend onto connector tabs 22*a*–*e* defined on the board. Thus, it can be seen from FIG. 1 that the interface of the present invention 10 retains and supports an electrical device 12 thereupon and allows for electrical contact to be made to the terminals of the device via a pattern of electrically conductive material extending onto a connector, such as connector tabs 22.

Figure 2:
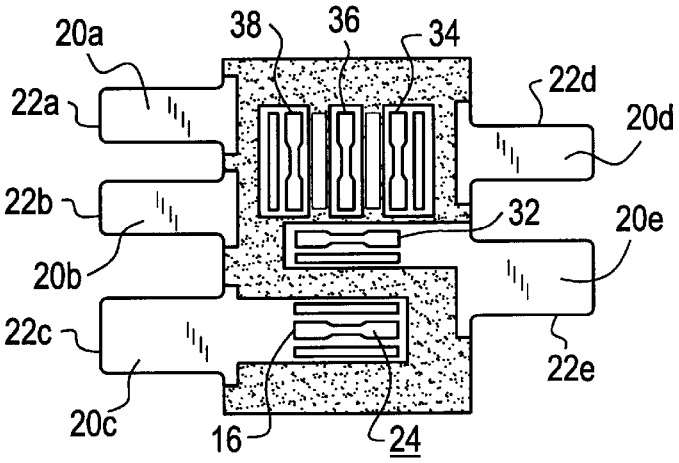
FIG. 2 is a top plan view of the terminal interface of FIG. 1.

Referring now to FIG. 2, there is shown a bottom plan view of the terminal interface of FIG. 1 with the electrical device removed therefrom. The interface 10 of FIG. 2, as noted, includes a terminal board 14 which is fabricated from a self-supporting, resilient, electrically insulating material. Within the context of the present invention, a resilient material is defined as a material which is capable of being elastically deformed and which substantially rebounds to its original shape after deformation. A terminal board material must be relatively rigid, but resilient, and should be capable of maintaining integrity under thermal and other environmental conditions of use likely to be encountered. In those instances where relatively large currents are flowing through the interface, resistive heating may occur, and the terminal board material should be capable of accommodating such heating. Likewise, conditions in the engine compartment of an automobile, or within industrial equipment, may cycle through a relatively large range, and the terminal board material should be capable of sustaining integrity over such a range.

There are a large number of materials which may be employed in the practice of the present invention. Among some of the preferred materials for the fabrication of the terminal board are organic polymers, used either alone, or in combination with fillers or reinforcing material such as glass fibers, ceramic fibers and the like. One specifically preferred material comprises a glass filled polyetherimide material, such as the material sold by the General Electric corporation under the trademark Ultem®. Unfilled polyetherimides may be similarly employed as may be other engineering polymers such as polyphenylene polymers, polysulfones, and the like. The thickness of the terminal board will depend upon the particular application; however, most terminal boards will have a thickness in the range of 1–5 mm. One specifically preferred thickness is 1.5 mm.

Figure 5:
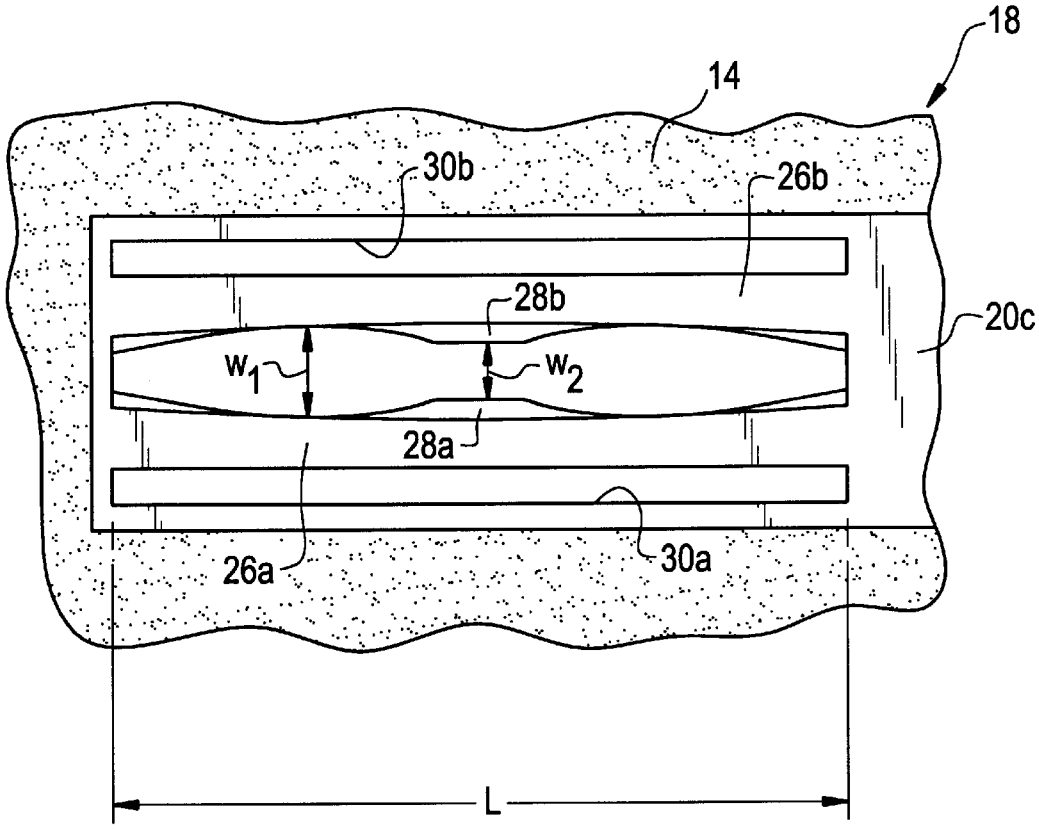
FIG. 5 is an enlarged, fragmentary view of a portion of the terminal interface of FIG. 2, illustrating a terminal socket thereof.

The terminal interface of the present invention includes a number of terminal sockets formed thereon. FIG. 5 is an enlarged view of one terminal socket 16. The socket 16 includes a terminal slot 24 formed through both faces of the terminal board 14. Terminal slot 24 has a length dimension L sized generally to accommodate the length of a terminal inserted therein. The width of the terminal slot, in this embodiment, varies along the length so that a first portion has a width $W_1$ and a second portion has a second width $W_2$ which is less than $W_1$. In this disclosure, the widths of the slot are all measured transverse to the length dimension.

The terminal slot 24 serves to define a first and a second contact beam 26*a*, 26*b* which are provided by those portions of the terminal board 14, immediately adjacent the terminal slot 24. The contact beams 26*a*, 26*b* each include a contact portion thereupon 28*a*, 28*b*, and these contact portions project into the terminal slot, and are defined by the narrower width portion $W_2$ thereof.

Owing to the resilience of the terminal board material, the contact beams 26 are sufficiently flexible so that they can be urged apart from one another in the plane of the terminal board 14. In some instances, it may be advantageous to increase the relative flexibility of the beams 28 by including one or more relief slots, for example relief slots 30*a*, 30*b*. These relief slots are disposed generally parallel to the length dimension L of the terminal slot. The relief slots 30 are optional, and one or both may in some instances be eliminated. In other instances, a single relief slot can be associated with two adjacent contact beams.

As will further be noted with regard to FIGS. 2 and 5, a pattern of electrically conductive material is disposed on the terminal board. In most instances, this pattern will comprise several discrete, electrically isolated bodies. As shown in FIG. 5, a conductive body 20*c* is associated with socket 16. This body covers at least a portion of one face of the terminal board 14, and also extends into the side wall of the terminal slot 24 so as to be present on at least the contact portions 28*a*, 28*b* of the side walls of the contact beams 26.

The terminal socket 16 is configured, and operative to receive and retain a blade type terminal having a length dimension which is no greater than the length dimension L of the terminal slot, and a width dimension which is less than $W_1$, but greater than $W_2$. When a terminal blade of this size is inserted into the socket 18, the contact regions 28*a*, 28*b* of the contact beams 26*a*, 26*b* are biased apart by the blade. Finn contact with the blade is maintained by the resilience of the beams 26*a*, 26*b*, and the electrically conductive body 20*c* establishes electrical communication with the blade. As will be seen from FIG. 2, the conductive body 20*c* extends out onto tab 22*c*, which tab can then be connected to an electrical circuit, a power supply, or the like.

From the foregoing, it will be appreciated that the remaining sockets of the terminal interface of this embodiment are configured in a manner generally similar to socket 16.

The terminal interface of the present invention allows for electrical contact to be established to a terminal, from either side, or both sides, of the terminal board. As shown in FIG. 2, terminal socket 16 and terminal socket 32 have conductive bodies 20*c* and 20*e* respectively disposed on this first face of the board 14, while the remaining sockets 34, 36 and 38 are electrically isolated from the conductive bodies illustrated in FIG. 2.

Figure 3:
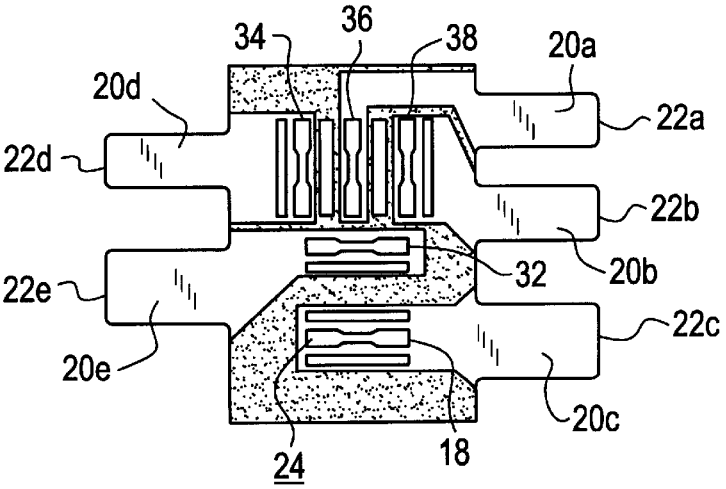
FIG. 3 is a bottom plan view of the terminal interface of FIG. 1.

Referring now to FIG. 3, there is shown a plan view of the terminal board 14 of FIG. 2, taken from the second face thereof. As will be seen herein, terminal socket 34 is in electrical communication with the conductive pattern 20*d*, and thence with connector tab 22*d*. Likewise, terminal socket 36 is in electrical communication with conductive body 20*a*, and thence with connector tab 22*a*. Likewise, connector socket 38 is in electrical communication with conductive pattern 20*b*, and thence with connector tab 22*b*.

It is also notable that sockets 16 and 32 are in electrical communication with their respective tabs 22*c* and 22*e* via conductive bodies 20*c*, 20*e* so disposed on this second face. Thus it will be seen that electrical communication to the respective tabs may be established by electrically conductive bodies disposed on either, or both, faces of the terminal board. In general, double-sided communication is favored where relatively large amounts of current must be supplied to a device, while single-sided connections are sufficient for lower current levels.

The electrically conductive pattern is most preferably formed from a layer of metal, such as copper, nickel, tin, lead, or combinations thereof. The electrically conductive pattern may be formed by a variety of techniques well known in the art. One particularly preferred method comprises a photo etch technique of the type wherein an appropriate metal pattern is formed by masking and etching, or by masking followed by selective metalization. Metalization techniques whereby high quality, low resistivity metal layers may be formed on the interior surface of through holes are well known in the art and can be readily adapted to the present invention. In general, it has been found that in those instances where the conductive pattern is formed from a plated copper layer, a thickness of approximately 2 mils provides very good current carrying capacity for single-sided connections. In those instances where dual-sided connections are employed, the thickness of the pattern will be sufficient if it is approximately 1 mil per side.

Other metalization techniques such as metal foil embossing, vapor deposition, electroless plating and the like may be similarly employed. In some instances, particularly where relatively lower levels of current are being carried, electrically conductive inks, pastes and the like may be employed to form the electrically conductive pattern.

A novel and unexpected finding of the present invention is that high quality, low resistivity, durable electrical contacts may be formed through the use of the monolithic interface of the present invention. The resistivity of a terminal connection is proportional to the normal force between the interior surface of the socket and a blade terminal inserted therein. In general, it has been found that through the use of the present invention, high quality, low resistivity connections to brass and copper blade terminals can be established when the normal force between the socket and the terminal is approximately 10 Newtons. In general, the terminal interfaces of the present invention are configured so that the normal force between the socket and terminal is approximately 15 to 20 Newtons. This provides for a high quality reliable contact, while still maintaining insertion force at an acceptable level, typically 20 Newtons.

Figure 4:
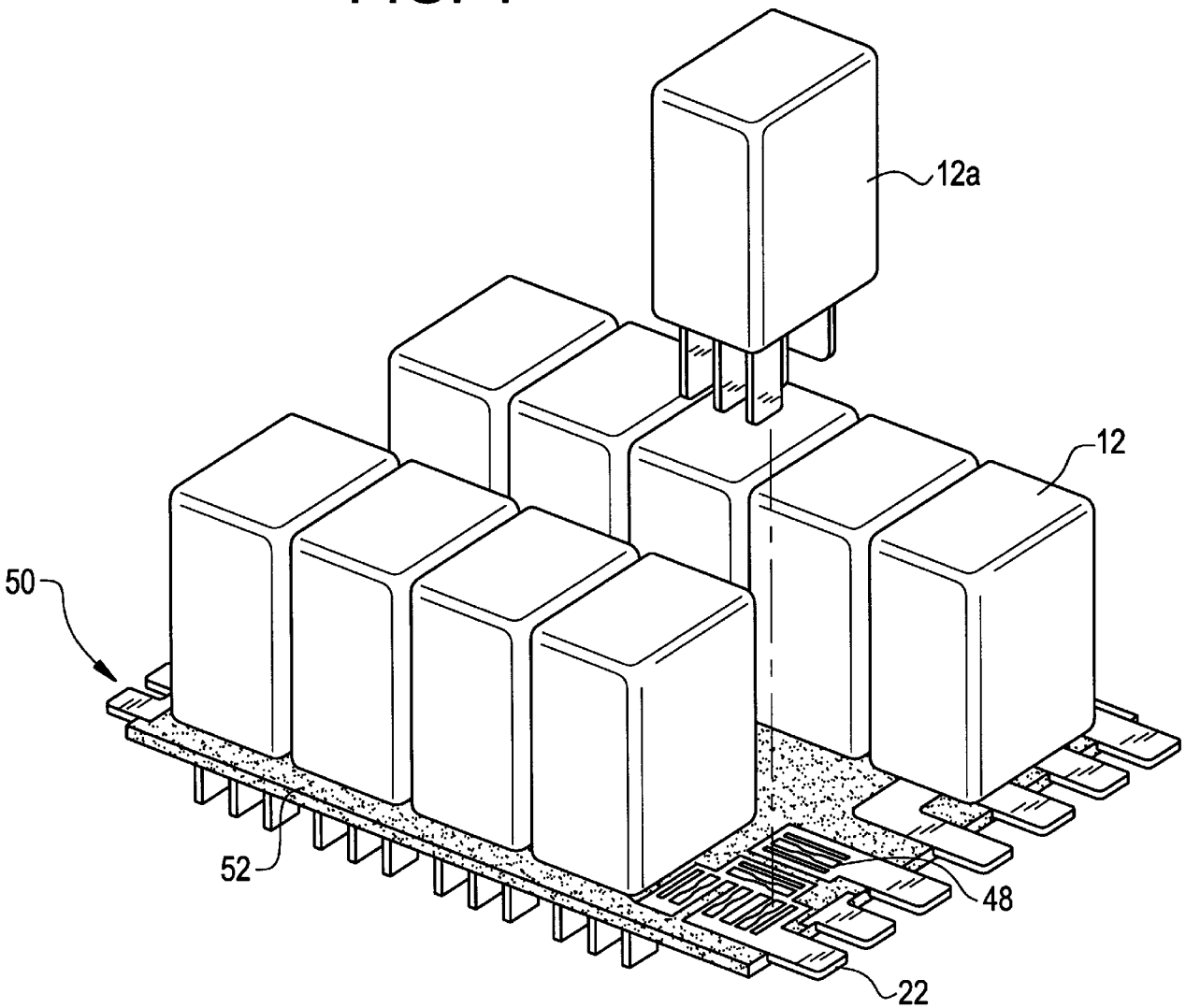
FIG. 4 is a perspective view of another embodiment of the terminal interface of the present invention as particularly configured for use in a motor vehicle power distribution box.

The terminal interface of the present invention can also be implemented in other configurations. For example, now referring to FIG. 4, there is shown a large size, monolithic terminal interface 50, structured in accord with the principles of the present invention, as particularly adapted for use in a power distribution box of a motor vehicle. As in the previous embodiment, the terminal interface 50 of FIG. 4 is built onto a terminal board 52. The interface 50 is configured to support a plurality of relays 12 thereupon, and as illustrated, one of the relays, 12*a*, is shown in a removed position and it will be seen that a plurality of terminal sockets, for example socket 48, are disposed on the board 52. The sockets are as generally described and are in electrical communication with a plurality of connector tabs, for example tab 22, as also described hereinabove.

The terminal interface of FIG. 4 can be readily integrated into a power distribution box by connection of the connector tabs 22 to appropriate connection points in the box. It is notable that the monolithic terminal interface 50 of FIG. 4 replaces previous assemblies which were comprised of molded polymeric connector housings, and metallic terminals retained therein by locking wedges. The terminal board can be formed by a molding process, and in that regard can include standoffs, connectors, fittings and similar members integral therewith. In addition, surface mounted devices such as diodes, transistors and the like can be directly mounted onto the surface of the terminal board. The terminal interface of the present invention decreases the size of the power distribution box, eliminates the use of stamped metal, current carrying frets and thereby decreases the weight and complexity of a power distribution box. In addition, the simple nature of the terminal board allows for ready reconfiguration when designs and requirements change.

It is to be understood that yet other modifications and variations of the present invention may be implemented. For example, the terminal slot may be configured other than as is shown herein. For example, the terminal slot may be configured so that each contact beam includes a plurality of contact regions. Similarly, one of the beams may be made relatively straight thereby eliminating projecting contact regions, so that the entirety of the beam is a contact region. In yet other instances, the entire slot may be slightly curved so as to provide appropriate contact regions. Yet other modifications and variations of the invention will be readily apparent to one of skill in the art in view of the drawings, discussion and description presented herein. Therefore, it is to be understood that the foregoing are merely meant to illustrate particular embodiments of the invention, but are not meant to be limitations upon the practice thereof. It is the following claims, including all equivalents, which define the invention.

What is claimed is:

1. A monolithic, terminal interface for receiving and retaining an electrical terminal member of an electrical device, said terminal interface comprising:

a terminal board comprising a self-supporting sheet of a resilient, electrically insulating material having opposed first and second faces, said terminal board having a terminal slot defined therethrough so as to pass from said first face to said second face, said terminal slot having a length dimension (L) parallel to said faces, a first width dimension ($W_1$) and a second width dimension ($W_2$) such that said first width dimension ($W_1$) is greater than said second width dimension ($W_2$), said terminal slot defining a first and a second contact beams in said terminal board, each contact beam having a length dimension at least equal to said length dimension of said terminal slot (L), and each contact beam having a contact region defined thereupon, said contact beams being in an opposed relationship so that the contact region of the first beam is spaced from the contact region of the second beam, such that the contact region of the first contact beam and the contact region of said second contact beam are substantially aligned and in an opposed relationship so as to be separated by a distance equal to said second width dimension (W2), and such that the terminal slot and contact beams provide a terminal socket configured to receive and retain said electrical terminal member having a thickness which is less than said first width dimension ($W_1$), but greater than said second width dimension ($W_2$); and a pattern of an electrically conductive material disposed on one face of said terminal board and extending into said terminal slot so as to cover at least a portion of the contact region of at least one of said contact beams.

2. The terminal interface of claim 1, wherein the contact region of one of said contact beams is spaced from the other contact beam by a distance which is less than said first width dimension ($W_1$).

3. The terminal interface of claim 1, wherein said pattern of said electrically conductive material is disposed so as to cover at least a portion of the contact region of each of said contact beams.

4. The terminal interface of claim 1, further including a relief slot defined in said terminal board so as to extend from the first face thereof to the second face thereof, said relief slot being spaced from said terminal slot, and having a longitudinal axis which is disposed in a generally parallel relationship with the length dimension (L) of said terminal slot.

5. The terminal interface of claim 1, wherein said pattern of electrically conductive material is disposed on both faces of said terminal board.

6. The terminal interface of claim 1, further including a plurality of terminal slots defined therein, each terminal slot of said plurality defining a corresponding first and second contact beams, said plurality of terminal slots and corresponding plurality of contact beams providing a plurality of terminal sockets.

7. The terminal interface of claim 6, wherein said pattern of electrically conductive material includes a plurality of electrically isolated bodies of electrically conductive material, said pattern covering at least some of the contact region of at least some of said plurality of beams.

8. The terminal interface of claim 1, wherein said terminal board further includes a contact portion defined thereupon, and wherein said pattern of electrically conductive material covers at least a part of said contact portion.

9. The terminal interface of claim 8, wherein said contact portion comprises at least one contact tab which projects from said terminal board.

10. The terminal interface of claim 1, wherein said electrically conductive material comprises a metal.

11. The terminal interface of claim 10, wherein said metal is selected from the group consisting of copper, nickel, tin, lead, zinc, and combinations thereof.

12. The terminal assembly of claim 10, wherein said metal has a thickness in the range of 0.5–5 mils.

13. The terminal assembly of claim 1, wherein said terminal board is comprised of a polymeric material.

14. The terminal interface of claim 13, wherein said polymer is a polyetherimide.

15. The terminal interface of claim 14, wherein said polymer includes a glass filler.

16. In an electrical distribution box for a motor vehicle, said box being of the type which supports and retains a plurality of multi-terminal electrical devices therein, and provides electrical communication between a source of electrical power and said electrical devices, wherein the improvement comprises in combination:

said electrical distribution box including a monolithic terminal interface therein, said monolithic terminal interface being operable to support said plurality of electrical devices thereupon, provide electrical communication to the terminals of said electrical devices, and provide a contact for establishing electrical communication between said source of electrical power and said plurality of electrical devices, wherein said monolithic terminal interface comprises:

a terminal board comprising a self-supporting sheet of a resilient, electrically insulating material having opposed first and second faces, said terminal board having a terminal slot defined therethrough so as to pass from said first face to said second face, said terminal slot having a length dimension (L) parallel to said faces, a first width dimension ($W_1$) as measured transverse to said length dimension (L), and a second width dimension ($W_2$) as measured transverse to said length dimension (L), such that said first width dimension ($W_1$) is greater than said second width dimension (W2), said terminal slot defining a first and a second contact beams in said terminal board, each contact beam having a length dimension at least equal to said length dimension (L) of said terminal slot, and each contact beam having a contact region defined thereupon, said contact beams being in an opposed relationship so that the contact region of the first beam is spaced from the contact region of the second beam, such that the contact region of the first contact beam and the contact region of said second contact beam are substantially aligned and in an opposed relationship so as to be separated by a distance equal to said second width dimension (W2), and such that said terminal slot and said contact beam provide a terminal socket configured to receive and retain an electrical terminal of one of said plurality of electrical devices; and a pattern of an electrically conductive material disposed so as to cover at least a portion of the contact region of one of said contact beams so as to provide electrical communication with a terminal disposed in contact with said contact region.

* * * * *